United States Patent [19]

Good et al.

[11] 4,317,707

[45] Mar. 2, 1982

[54] PORTABLE ELECTROLYSIS UNIT FOR RECOVERY OF SILVER FROM PHOTOGRAPHIC FILM

[76] Inventors: David L. Good, 3708 Hickman Rd., Des Moines, Iowa 50310; Dallis L. Good, P.O. Box 1354, Middlesboro, Ky. 40965

[21] Appl. No.: 203,312

[22] Filed: Nov. 3, 1980

[51] Int. Cl.[3] ..... C25C 7/00; C25C 7/02

[52] U.S. Cl. ..... 204/213; 204/271

[58] Field of Search ..... 204/213, 271

[56] References Cited

U.S. PATENT DOCUMENTS

| | | | |
|---|---|---|---|
| 706,436 | 8/1902 | Mumford | 204/213 |
| 1,509,534 | 9/1924 | Todd | 204/213 |
| 3,330,753 | 7/1967 | Hepfer | 204/213 |
| 3,340,174 | 9/1967 | Buynak | 204/213 |

FOREIGN PATENT DOCUMENTS

| | | | |
|---|---|---|---|
| 145103 | 3/1961 | U.S.S.R. | 204/213 |

*Primary Examiner*—R. L. Andrews

*Attorney, Agent, or Firm*—Zarley, McKee, Thomte, Voorhees & Sease

[57] ABSTRACT

The device is a portable drum having a removable end cap and a removable plug. The end cap is electrically connected to an electric current and has a pair of anodes secured to the inside thereof. A cathode is mounted on the inside of the end cap, along with a perforated basket. The film is chopped up and placed in the drum. Bleach, water, and photography fixer solution are added through the plug. The solution washes the silver ions off of the film as the drum is rotated about its axis. The silver collects on the negatively charged cathode. The perforated basket prevents any pieces of film from coming in contact with the cathode. The cathode can then be removed and the silver removed from the cathode.

17 Claims, 9 Drawing Figures

PORTABLE ELECTROLYSIS UNIT FOR RECOVERY OF SILVER FROM PHOTOGRAPHIC FILM

BACKGROUND OF THE INVENTION

Silver bromide is the light sensitive compound that is responsible for the production of most types of photographs. The silver bromide, a cream white solid, is dispersed in gelatin and the mixture is spread on the cellulose or film. In some cases, silver chloride or silver iodide may be used for special purpose films. After the film has been exposed, it is placed in a developing bath, for example, hydroquinone, or some other reducing agent to reduce the silver bromide to pure silver.

With the ever increasing price of silver, it is desirable to recover this silver in metal form so that it may be sold. Silver may be collected from negative film, printed film, x-ray film or any other film which uses a silver base for its developing process.

Accordingly, a primary object of this invention is to provide an improved portable electrolysis unit for recovery of silver from photographic film.

A further object of this invention is to provide a device for use by amateur or professional photographers which is inexpensive, which facilitates recovery of silver as pure as 97% and which is economical to manufacture.

The method and manner of accomplishing each of these objectives, as well as others, will become apparent from the detailed description of the invention which follows.

SUMMARY OF THE INVENTION

The device utilizes a cylindrical drum which is rotated upon a pair of rollers located in a base which has a small electric motor for driving the rollers. The drum has a removable end cap which is in electrical contact with an electric current. An anode and a cathode are functionally secured to the end cap and electrically connected to the current. Photographic film is chopped up and placed inside the drum and the end cap is threaded into place. A removable plug allows a solution of bleach, water, and photographic fixer to be added to the drum. As the drum is rotated, the solution washes the silver off of the film and the silver is electrically attracted to the cathode. A perforated basket prevents the film from coming in contact with the cathode. When the process is complete, the cathode can be removed and the silver collected.

DETAILED DESCRIPTION OF THE INVENTION

Figure 2:
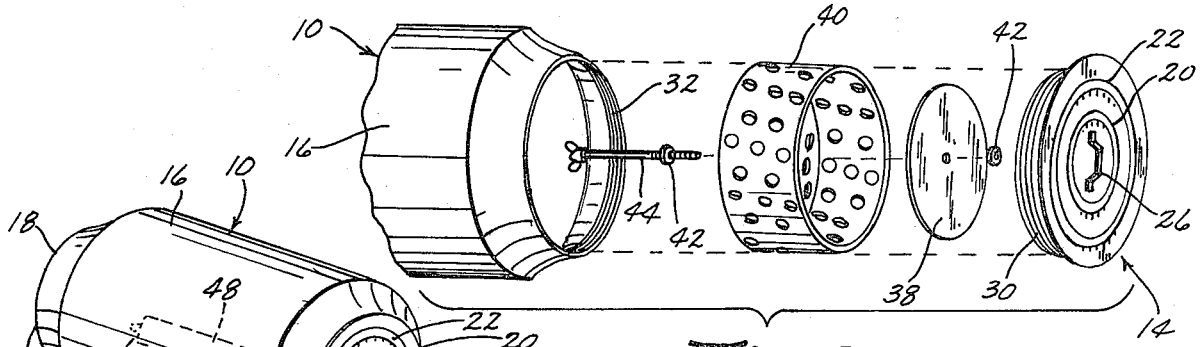
FIG. 2 is an exploded view showing component parts of the device.
Figure 1:
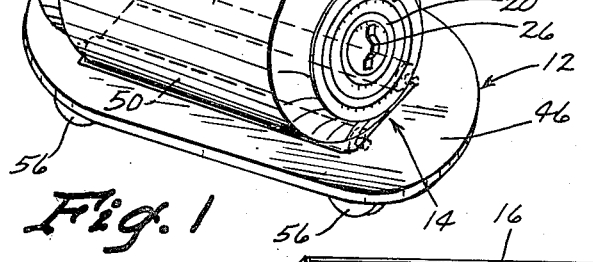
FIG. 1 is a perspective view of the device of the invention.

Referring to the drawings, numeral 10 generally designates the drum, numeral 12 generally designates the base, and numeral 14 generally designates an end cap.

The drum comprises removable end cap 14, a side wall 16, and a permanent end cap 18. Attached to the opposite ends and sides of the drum 10 is a perforated spiral tube 21 which helps to agitate the solution as the drum is rotated about its axis. End cap 14 includes an outer wall 15 having a central opening 17 therein. An inner wall 19 is spaced axially inwardly from outer wall 15. Preferably end cap 14 is constructed of dielectric material. The removable end cap 14 has a large ring 22 and a small ring 20 on the exterior surface of outer wall 15 which provide positive and negative electrical contact, respectively, for positive and negative electric leads 24, 25 shown schematically in FIG. 3. Leads 24, 25 include brushes 27, 29 for frictionally engaging rings 20, 22, respectively. Brushes 27, 29 may be supported mechanically in any conventional fashion, and therefore the means for supporting them are not shown. End cap 14 also has an exterior handle 26 and an interior handle-like portion 28 both constructed of electrically conductive material. The removable end cap 14 has male threads 30 which threadably engage female threads 32 of the drum 10. A pair of anodes 34 are connected to the inside of inner wall 19 of the removable end cap 14. Anodes 34 are electrically connected by wire 36 or other suitable connecting means to the large ring 22 of the removable end cap 14. Anodes 34 are thus connected to the positive charge of the electric current which may be either alternating or direct. A cathode plate 38 and a mesh basket 40 are secured to the handle-like portion 28 and the end cap 14, respectively, by a pair of nuts 42 and an elongaged bolt 44. The handle-like portion 28 spaces the cathode 38 apart from the anodes 34. The cathode 38 is in electrical connection with the small ring 20 by virtue of the electrical continuity through portion 28, rivets or bolts 31, handle 26, and a wire or other connector 37. Thus, when the electric current is switched on, the silver removed from the film by the solution is electrolyzed and deposited on the cathode.

The drum 10 can be made of metal or plastic and can be coated on the inside with silicone carbide to prevent corrosion.

The base 12 is comprised of a flat portion 46 with a hole in the center where a pair of rollers 48 and 50 are mounted. The rollers are spaced apart so as to retain the drum when it is in place. A small electric motor 52 is connected to roller 50 by means of meashing gears 51, 53, and drives roller 50 which is connected to roller 48 by a sprocket chain 55. The drum 10 is rotated about its axis when mounted on the spinning rollers. The base 12 also has an upright guide 54 which engages the permanent end cap 18 to prevent the drum from sliding rearwardly on the rollers. The base also has four coaster wheels 56 mounted on the bottom of the base which permit easy movement of the device.

In operation, the device works as follows: The chopped up photographic film is placed inside the drum 10 and the removable end cap 14 is threaded into place to close the drum. The mesh basket 40 and the cathode plate 38 have previously been secured to the inside of the end cap 14. The plug 19 is removed and one gallon of bleach is put into the drum. The plug is replaced and the drum is tumbled on the rollers for approximately 20 minutes. The plug is then removed and two and one-half gallons of water and one quart of photographic fixer solution is added to the drum. The plug is replaced and the electric current is switched on. The drum is then tumbled on the rollers until the electrolysis process is completed. The solution washes the silver off of the film. As the process continues, the solution now containing silver passes through the mesh basket 40, and the silver is deposited on the negatively charged cathode 38. When the electrolysis process is complete, the current is switched off and the drum removed from the rollers. The end cap 14 is removed and the cathode 38 removed therefrom. Approximately one-fourth (¼) ounce of 97% pure silver can be collected per pound of film. The process takes approximately two hours when one amp of electric current is supplied.

Figure 3:
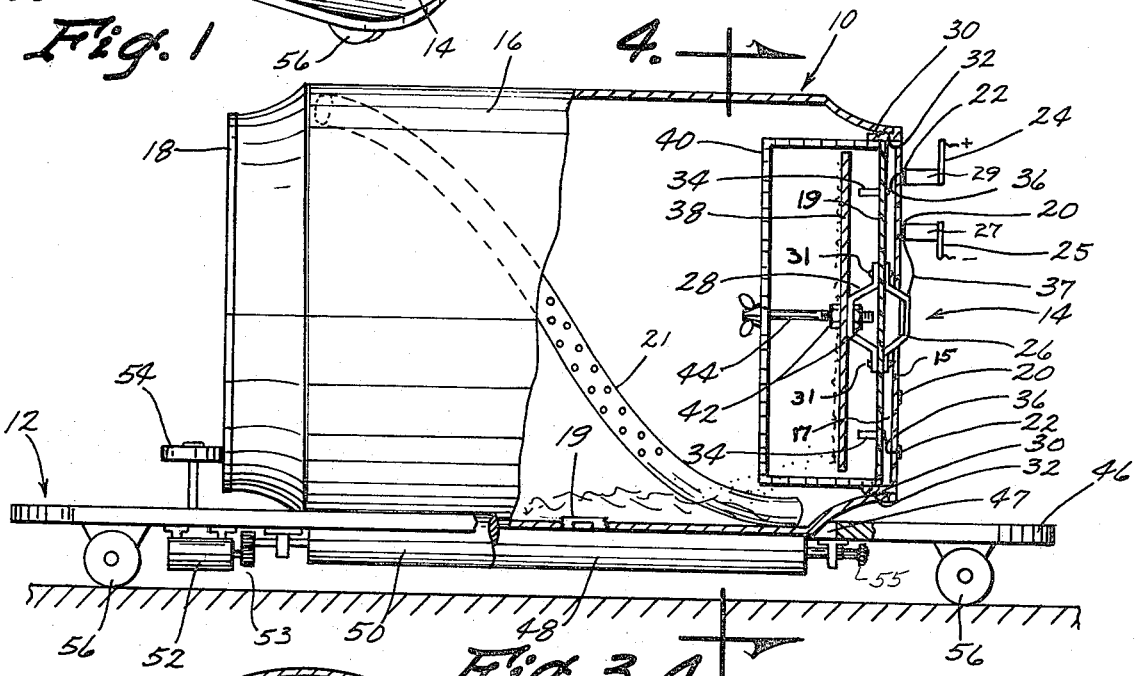
FIG. 3 is an elevational sectional view of the device.
Figure 4:
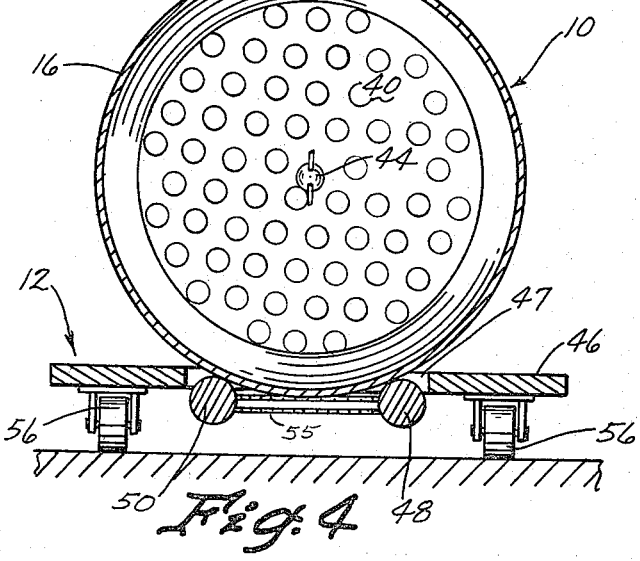
FIG. 4 is a sectional view taken along line 4—4 of FIG. 3.
Figure 5:
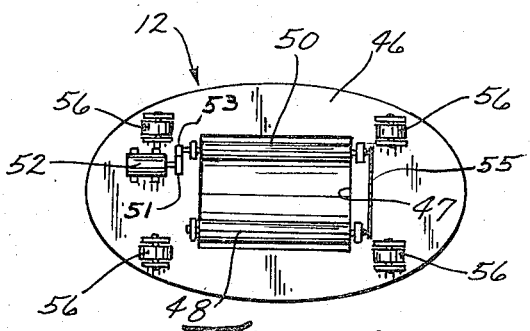
FIG. 5 is a view from the bottom of the device.
Figure 7:
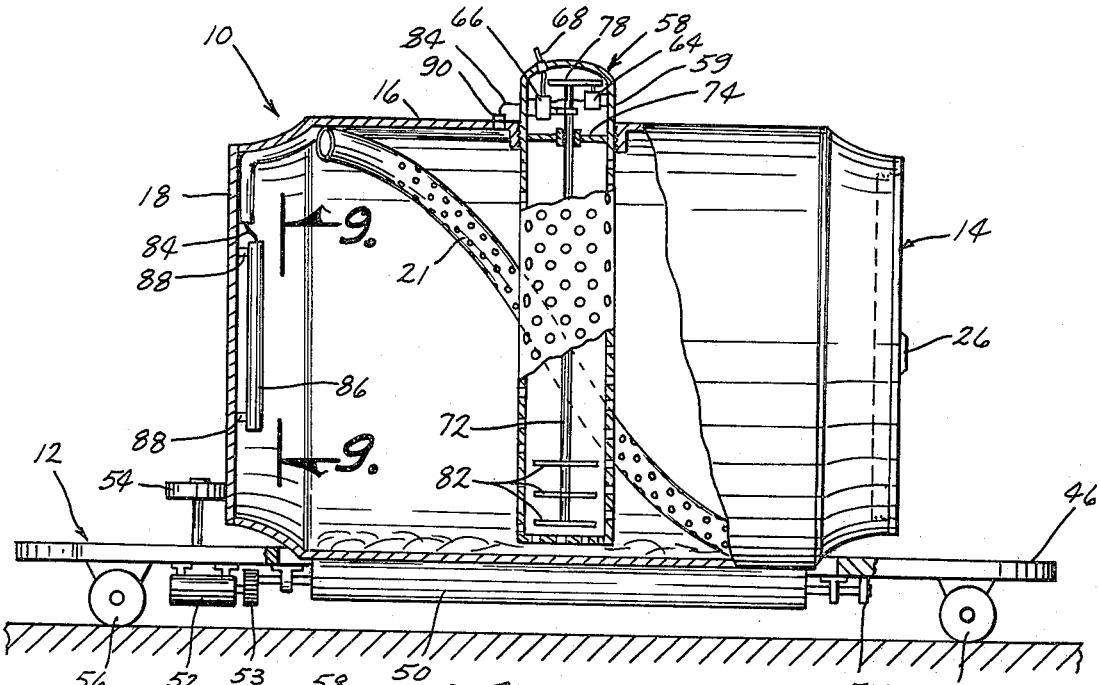
FIG. 7 is an elevational sectional view of the modified device.
Figure 6:
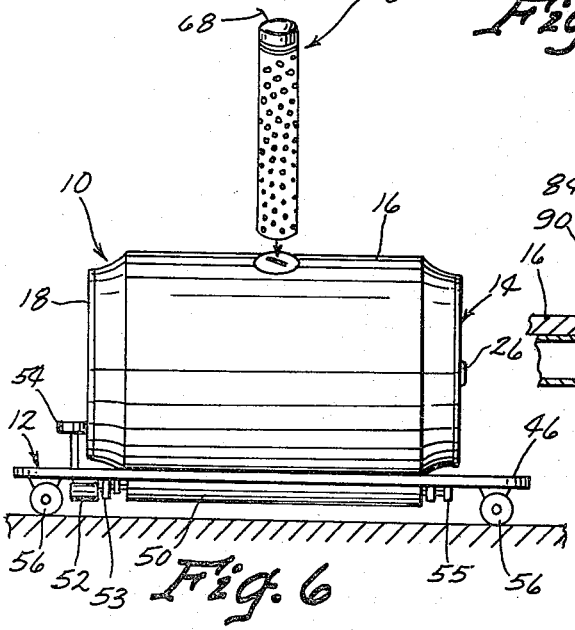
FIG. 6 is an elevational view of a modification of the device.
Figure 8:
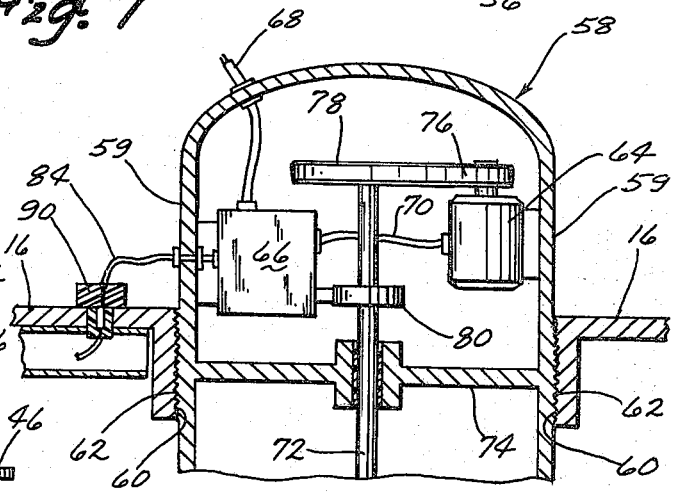
FIG. 8 is an enlarged view showing the electric connections of the core of the modified device.
Figure 9:
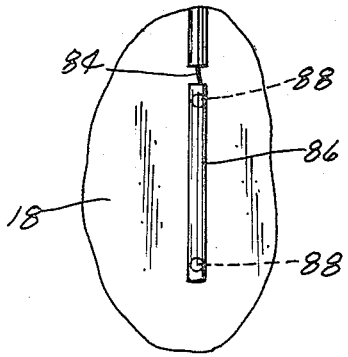
FIG. 9 is a sectional view showing the anode of the modified device.

In the modified form of the device, FIGS. 6 through 9, the base 12 of the device remains unchanged. The plug 19 of FIG. 3 is replaced with a perforated cylindrical core 58 which extends to the opposite side of the drum 10. The core has male threads 60 which fit into the corresponding female threads 62 of the drum 10, so that the core can be mounted therein. On the interior of the core 58 is mounted a small electric motor 64 and a transformer 66. Wire 68 supplies electricity to the transformer which in turn supplies power to the electric motor through wire 70. Also mounted in the core is an elongated shaft 72 which coincides with the axis of the core. A plastic mounting ring 74 serves to mount the shaft 72 while at the same time electrically insulating it from the walls of the core 59. The shaft 72 is rotated about its axis by a belt 76 interconnecting electric motor 64 and a belt drive disc 78 connected to the top of the shaft 72. A small slip ring 80 electrically connects the shaft 72 to the electric terminal of the transformer 66, thus supplying a negative electric charge to the cathodes 82. A wire 84 provides a positive electric charge from the transformer 66 to the anode 86. The anode 86 is electrically insulated and mounted upon the rear wall 18 by plastic connectors 88. A small plug 90 provides a quick and easy means of electrically connecting the anodes of the transformer.

In operation, the modified device works as follows: The chopped-up photographic film is placed inside the drum 10 and the removable end cap 14 is threaded into place to close the drum. The plug 19 is removed and one gallon of bleach is put into the drum. The plug is replaced and the drum is tumbled on rollers for approximately 20 minutes. The plug is then removed and 2½ gallons of water and one quart of photographic fixer solution is added to the drum. The perforated core 58 is then threaded into place. The electric current is then switched on and the electrolysis process takes place. The silver ions pass through the perforated core 58 and are deposited on the negatively charged cathodes 82. In this modified form, the drum is not rotated while the electrolysis process is proceeding.

It therefore can be seen that the device of the present invention accomplishes at least all of its stated objectives.

What is claimed is:

1. A portable electrolysis device for recovering silver from photographic film, comprising:

an elongated cylindrical drum wherein the electrolysis and recovery of silver from photographic film takes place, said drum having a cylindrical side wall and a forward and rearward end, said forward end having a circular end cap detachably secured over said forward end;

an interior cylindrical mesh basket mounted within said drum and attached to said end cap;

said end cap having separate positive and negative electrical contact means located on the exterior surface thereof;

a cathode plate operatively mounted within said mesh basket; whereby said mesh basket prevents said film from contacting said cathode plate;

at least one anode mounted within said mesh basket in spaced relation to said cathode plate;

first connecting means providing electrical connection between said cathode plate and said negative contact means;

second connecting means providing electrical connection between said anode and said positive contact means;

an elongated base having a bearing means for supporting and rotating said drum about its longitudinal axis.

2. A device according to claim 1 wherein said end cap has an exterior and interior side, an exterior handle and male threads whereby said end cap can be threadably secured to said drum; said positive and negative contact means comprising large and small electrically conducting rings, respectively.

3. A device according to claim 1 wherein said anode is operatively connected to said interior side of said end cap and is in electrical contact through said second connecting means with said large ring of said end cap.

4. A device according to claim 2 wherein said mesh basket has an open forward end and a perforated rear end and a perforated cylindrical side wall, said side wall having a diameter smaller than that of said end cap.

5. A device according to claim 4 wherein said cathode plate has a diameter less than that of said basket, and is in electrical contact with said small ring of said end cap.

6. A device according to claim 5 wherein said first connecting means comprises an elongated bolt passing through said basket through said cathode plate, and through an electrically conductive handle-like portion connected to said interior side of said end cap; and a nut and said bolt operatively securing said basket and said cathode plate to said handle-like portion.

7. A device according to claim 1 wherein said drum has a removable plug located in said side wall.

8. A device according to claim 1 wherein said base comprises a pair of spaced apart rollers which support said drum along its length, a motor drivingly connected to one of said rollers for rotating said drum about its longitudinal axis, an upwardly extending guide engaging one of said forward and rearward ends of said drum for preventing said drum from sliding longitudinally on said rollers, and four coaster wheels mounted on the bottom side of said base.

9. An end cap according to claim 5 wherein said handle-like portion positioned between and in contact with said end cap and said cathode plate and holds said cathode plate sufficiently far away from said end cap to cause said cathode plate to be spaced apart from said anodes.

10. A portable electrolysis device for recovering silver from photographic film, comprising:

an elongated cylindrical drum wherein said electrolysis and recover of silver from photographic film takes place, said drum having a side wall and a forward and rearward end, said forward end having a circular end cap detachably secured over said forward end;

an elongated base having a bearing means for supporting and rotating said drum about its longitudinal axis;

a removable perforated cylindrical core extending into the interior of the drum, and having mounted on its interior an electric motor, a transformer, and a shaft coinciding with the axis of said core; said transformer being electrically connected to a power supply, said electric motor being electrically connected to said transformer, and said shaft being rotatably driven by said electric motor thereby aiding the recovery of silver process;

at least one cathode plate mounted on said shaft, whereby said perforated cylindrical core prevents said film from contacting said cathode plate, and said cathode plate being in electrical contact with said transformer, at least one anode mounted within said drum in spaced relation with said cathode and being in electrical contact with said transformer.

11. A device according to claim 11 wherein said shaft is rotated about its axis by a belt drivingly interconnecting said shaft and said electric motor.

12. A device according to claim 10 wherein said end cap has male threads whereby said end cap can be threadably secured to said drum.

13. A device according to claim 10 wherein said core has male threads whereby said core can be threadably secured to said drum.

14. A device according to claim 13 wherein said shaft is in electrical contact with the negative terminal of said transformer; said shaft also being electrically insulated from said core; and said cathode being electrically connected to said shaft.

15. A device according to claim 10 wherein said anode is mounted on said rearward end of said drum and electrically insulated therefrom; said anode being in electrical connection with the positive terminal of said transformer.

16. A device according to claim 10 wherein said drum has a removable plug located in said side wall.

17. A device according to claim 10 wherein said base comprises a pair of spaced apart rollers which support said drum along its length, a motor drivingly connected to one of said rollers for rotating said drum about its longitudinal axis, an upwardly extending guide engaging one of said forward and rearward ends of said drum for preventing said drum from sliding longitudinally on said rollers, and four coaster wheels mounted on the bottom side of said base.

* * * * *